US010487270B2

(12) United States Patent
Banerjee et al.

(10) Patent No.: US 10,487,270 B2
(45) Date of Patent: Nov. 26, 2019

(54) SYSTEMS AND METHODS FOR DELAYED COKING

(71) Applicant: THE UNIVERSITY OF TULSA, Tulsa, OK (US)

(72) Inventors: Dwijen K. Banerjee, Owasso, OK (US); Michael Volk, Tulsa, OK (US); Keith Wisecarver, Tulsa, OK (US); Glixon Mavarez Nava, Tulsa, OK (US)

(73) Assignee: The University of Tulsa, Tulsa, OK (US)

( * ) Notice: Subject to any disclaimer, the term of this patent is extended or adjusted under 35 U.S.C. 154(b) by 150 days.

(21) Appl. No.: 15/526,673

(22) PCT Filed: Nov. 20, 2014

(86) PCT No.: PCT/US2014/066649
§ 371 (c)(1),
(2) Date: May 12, 2017

(87) PCT Pub. No.: WO2016/080999
PCT Pub. Date: May 26, 2016

(65) Prior Publication Data

US 2017/0321127 A1 Nov. 9, 2017

(51) Int. Cl.

| | |
|---|---|
| ***C10G 9/00*** | (2006.01) |
| ***C10B 55/00*** | (2006.01) |
| ***C10B 57/00*** | (2006.01) |
| ***C10G 51/04*** | (2006.01) |
| ***C10G 69/04*** | (2006.01) |
| ***C10G 69/06*** | (2006.01) |
| ***C10K 1/00*** | (2006.01) |

(52) U.S. Cl.
CPC ..... *C10G 9/005* (2013.01); *C10B 55/00* (2013.01); *C10B 57/005* (2013.01); *C10G 51/04* (2013.01); *C10G 69/04* (2013.01); *C10G 69/06* (2013.01); *C10K 1/003* (2013.01); *C10K 1/004* (2013.01); *C10G 2300/4081* (2013.01)

(58) Field of Classification Search
CPC ..... C10G 9/005
See application file for complete search history.

(56) References Cited

U.S. PATENT DOCUMENTS

| | | | |
|---|---|---|---|
| 2,985,585 | A | 5/1961 | Scott |
| 4,113,602 | A | 9/1978 | Gorbaty |
| 4,216,074 | A | 8/1980 | Simone |

(Continued)

FOREIGN PATENT DOCUMENTS

| | | | |
|---|---|---|---|
| CN | 104194826 | A | 12/2014 |

OTHER PUBLICATIONS

International Search Report and Written Opinion of the International Searching Authority dated Mar. 24, 2015 filed in related application PCT/US14/66649.

(Continued)

*Primary Examiner* — Renee Robinson
(74) *Attorney, Agent, or Firm* — McAfee & Taft

(57) ABSTRACT

Disclosed is an improved system and method for carrying out the petroleum coking process. The improvements provide for recovery of gaseous hydrocarbons from operational units and use of the recovered gaseous hydrocarbons in place of steam during the coking process and during the stripping of volatile compounds from the coke drums.

23 Claims, 2 Drawing Sheets

(56) References Cited

U.S. PATENT DOCUMENTS

| | | | | |
|---|---|---|---|---|
| 4,394,250 | A | 7/1983 | Grossberg | |
| 4,492,625 | A | 1/1985 | Allan | |
| 4,512,873 | A | 4/1985 | Escher et al. | |
| 4,518,487 | A | 5/1985 | Graf et al. | |
| 4,519,898 | A * | 5/1985 | Allan | C10B 55/00 208/131 |
| 4,661,241 | A | 4/1987 | Dabkowski et al. | |
| 4,797,197 | A | 1/1989 | Mallari | |
| 5,114,564 | A | 5/1992 | Goyal | |
| 5,645,712 | A | 7/1997 | Roth | |
| 5,711,870 | A | 1/1998 | Storm et al. | |
| 8,784,743 | B2 | 7/2014 | Keusenkothen et al. | |
| 2009/0145810 | A1 * | 6/2009 | Etter | C10G 9/005 208/52 R |
| 2010/0108570 | A1 | 5/2010 | Nath et al. | |
| 2011/0005911 | A1 | 1/2011 | Bernatz et al. | |
| 2012/0125813 | A1 | 5/2012 | Bridges et al. | |
| 2014/0048445 | A1 | 2/2014 | Etter | |

OTHER PUBLICATIONS

Tutorial: Delayed Coking Fundamentals, Ellis, Paul J. and Paul, Christopher A. dated Mar. 9, 1998 (Unpublished).

Suppression of Coke Formation During Bitumen Pyrolysis, Zachariah, Ashley, Wang, Lin, Yang, Shaofeng, Prasad, Vinay and De Klerk, Arno dated 2013 (Published 2013 American Chemical Society—Energy Fuels 2013).

* cited by examiner

SYSTEMS AND METHODS FOR DELAYED COKING

CROSS RELATED

This application claims the benefit of previously filed International Application PCT/US2014/066649 filed Nov. 20, 2014.

BACKGROUND

The delayed coking process is a cyclic process that typically requires 18-24 hours for a complete cycle. To improve operational efficiency, delayed cokers typically operate in pairs with one coke drum filling and carrying out the coking conversion process while the other coke drum undergoes decoking operations. Thus, the first half of each cycle includes conversion of hydrocarbon feedstock and filling of the coker drum. Upon substantial completion of the conversion reaction, a steam-stripping step substantially removes trapped volatile compounds from within the coke-bed. Following steam stripping the first half of the cycle concludes with blow-down and water quenching of the coke. The second half of each cycle involves the decoking process.

In the first half of the coking operation cycle, the steam-stripping step to remove volatile compounds commonly requires about an hour. The steam stripping step injects steam from a boiler through the bottom of the coke drum upward through the coke-bed thereby transferring heat to and carrying volatile compounds out through the overhead line of the coke drum.

The conversion of heavy petroleum products to coke and additional liquid products follows well known kinetics and reaction mechanisms. During the coking conversion process, thermal cracking of the heavy hydrocarbons follows first order kinetics dominated by free radical reaction mechanisms described below.

Step—1 Thermal cracking—initiation reactions—random production of free radicals $$\text{Resid or Asphaltenes} \Longrightarrow Ar_x^{\circ}+Ar_y^{\circ}+R_1^{\circ}+R_2^{\circ}$$

Step—2 Propagation reactions—capping of free radicals (liquid and gas formation)

$$Ar_x^{\circ}+C_x\text{—}H_y \Longrightarrow \text{Ar—H (liquid)+free radicals}$$

$$R_1^{\circ} \text{ or } R_2^{\circ}+C_x\text{—}H_y \Longrightarrow R_1\text{—H or } R_2\text{—H (liquid)+ free radicals}$$

$$R_1^{\circ} \text{ or } R_2^{\circ} \Longrightarrow R_3{=} \text{ or } R_4{=}\text{(liquid)}+H_2+(C_1\text{-}C_4) \text{ Gaseous hydrocarbons}$$

Where:

Length of the carbon chain in $R_3$ & $R_4 < R_1$ & $R_2$ $R_3{=}$ and $R_4{=}$ are olefins $Ar_x^{\circ}$ & $Ar_y^{\circ}$ are free radicals of poly-nuclear aromatic structures (x and y being the number of aromatic nuclei)

$R_1^{\circ}$ & $R_2^{\circ}$ are free radicals of various paraffinic structures Step—3 Termination reactions (poly-condensation of aromatic free radicals)

$$Ar_x^{\circ}+Ar_y^{\circ} \Longrightarrow \text{Coke formation}$$

SUMMARY OF THE INVENTION

Disclosed herein is a system comprising a source of compressed gaseous hydrocarbons and a heater in fluid communication with the source of gaseous hydrocarbons.

The heater is configured to receive a stream of flowing gaseous hydrocarbons and heat the gaseous hydrocarbons. Additionally, a coke drum is in fluid communication with the heater via a first path of fluid communication.

The system further optionally comprises a vacuum distillation unit in fluid communication with the furnace and a boiler in fluid communication with the furnace. Additionally, a compressor suitable for compressing the gaseous hydrocarbons is in fluid communication with the furnace.

Additionally, this disclosure describes an improved coking method. The improved method initially heats liquid hydrocarbons and passes the hot hydrocarbons to a coking drum. The method calls for maintaining the coking drum at a temperature sufficient to initiate the coking reaction and substantially complete the reaction while permitting the recovery of volatile hydrocarbons. The traditional steam stripping of the solid coke is replaced by the steps of heating compressed gaseous hydrocarbons and passing the hot gaseous hydrocarbons to the coking drum to effect stripping of volatile hydrocarbons from the coke drum.

DETAILED DESCRIPTION OF THE INVENTION

Figure 1:
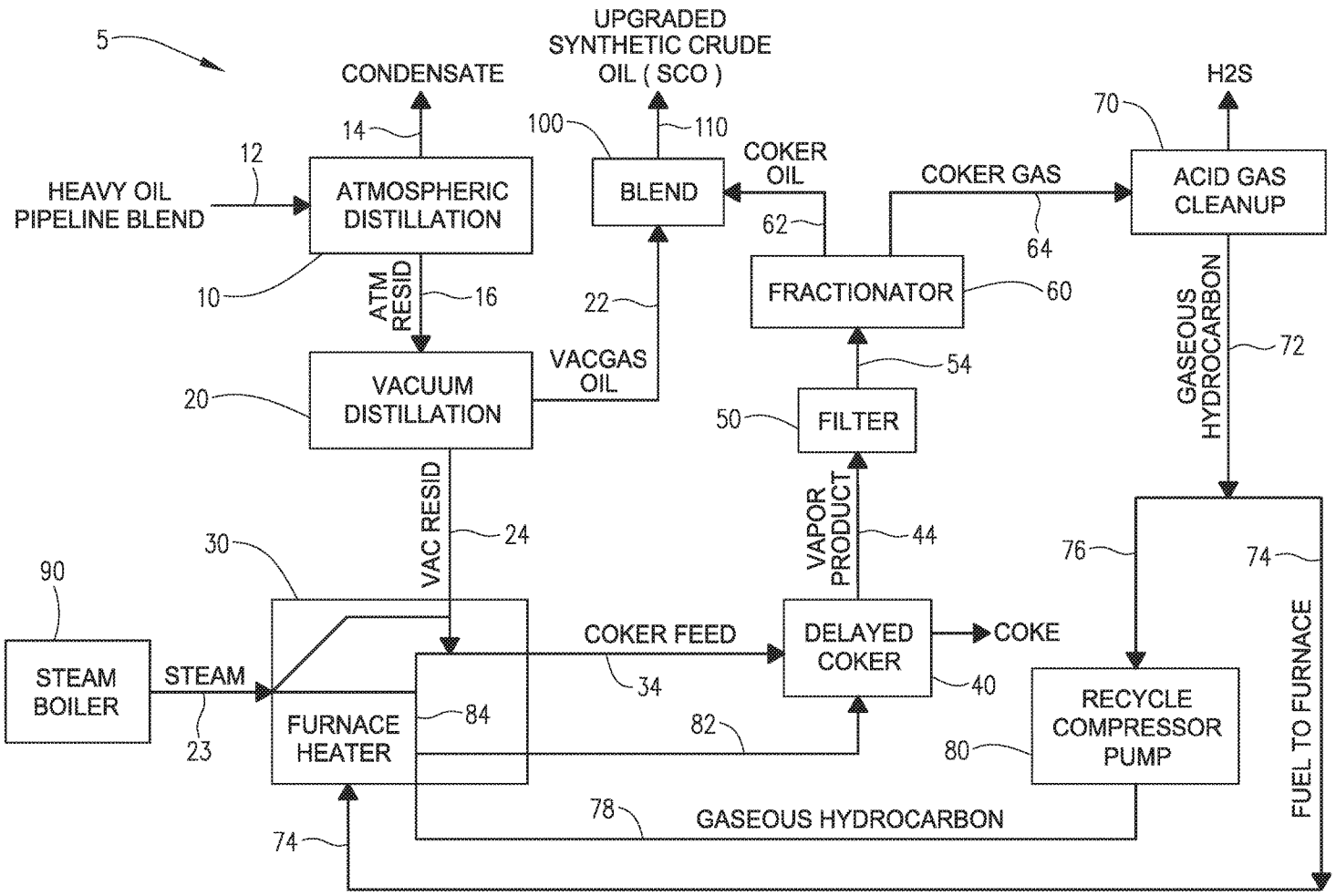
FIG. 1 schematically depicts a system suitable for upgrading heavy crude oil to a synthetic crude product.

With reference to FIG. 1, the present invention provides a system and methods for upgrading heavy hydrocarbons to a pumpable synthetic crude oil (SCO). As depicted in FIG. 1, the system and methods disclosed herein may be adapted for use in a crude oil upgrader. As known to those skilled in the art, crude oil upgraders upgrade heavy asphaltenes and other heavy hydrocarbons commonly obtained from oil sands and other similar extra-heavy crude oil production zones, or resid a complex mixture of heavy hydrocarbons to a SCO suitable for transport through pipelines and subsequent processing in a refinery.

Figure 2:
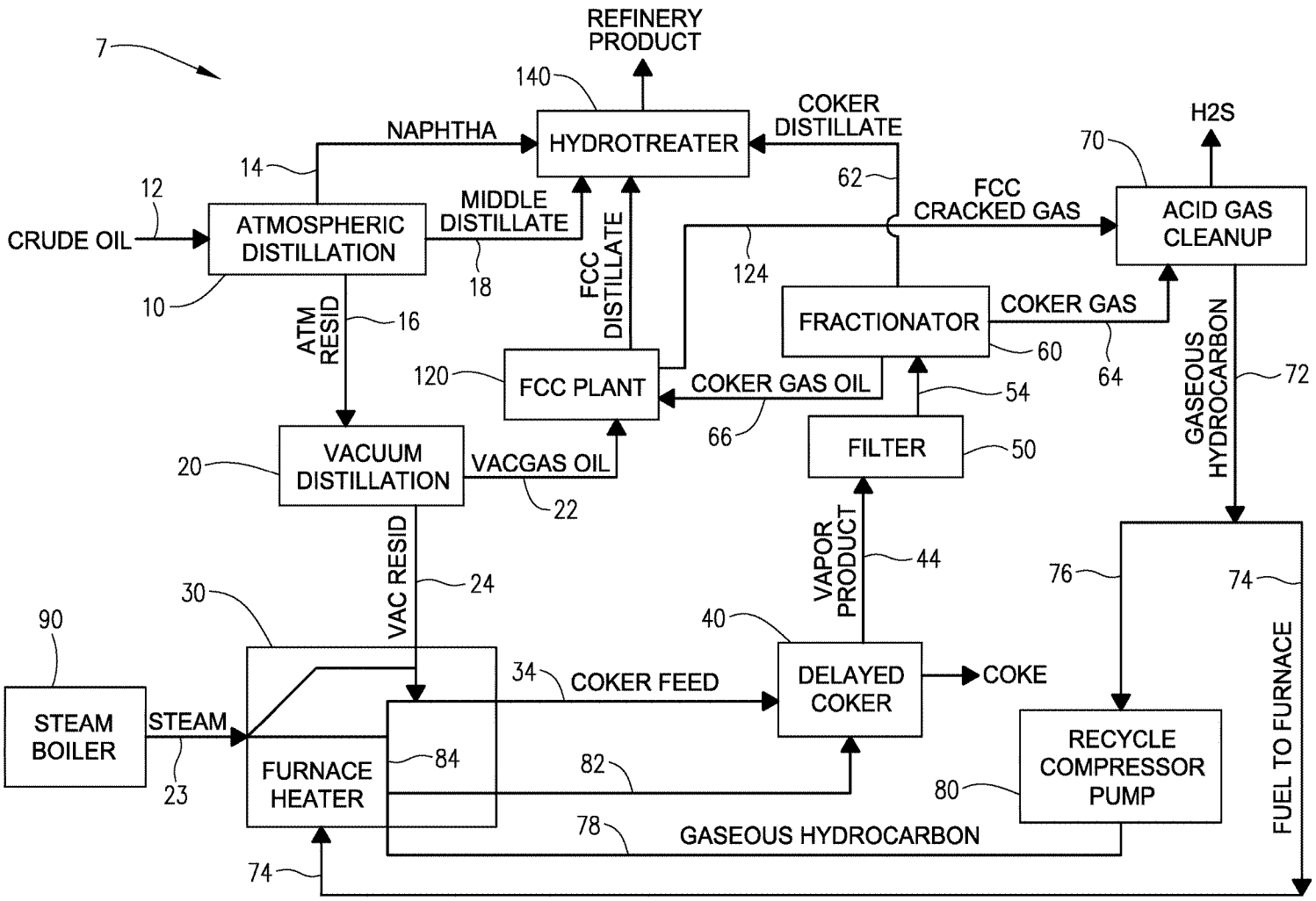
FIG. 2 schematically depicts a system suitable for increasing liquid yields produced by a delayed coker in a refinery.

With reference to FIG. 2, the present invention provides a system and methods for increasing the production of liquids from a delayed coker. As depicted in FIG. 2, when used in a refinery, the systems and methods disclosed increase production of valuable liquids such as gasoline, kerosene and other similar fuels.

Systems

With reference to FIG. 1, the present invention has been adapted to a system for upgrading very heavy hydrocarbons to SCO. Upgrading system 5 of FIG. 1 is a non-limiting example of a system for upgrading heavy hydrocarbons to SCO.

In the depiction of FIG. 1, system 5 includes: atmospheric distillation unit 10, vacuum distillation unit 20, furnace heater 30, delayed coker 40 (typically two coke drums, individual coke drums are not shown and will be referred to herein as coke drum 40), filter 50, coker fractionator 60, acid gas cleanup unit 70, compressor 80, steam boiler 90 and blender 100. Operations of acid gas cleanup unit 70, coker fractionator 60, atmospheric distillation unit 10, vacuum distillation unit 20 and blender 100 will not be discussed in detail as the operation of such units are well known to those skilled in the art.

As modified by the improvements discussed herein, system 5 may now operate without the need for steam boiler 90.

Specifically, system 5 has been modified by incorporation of lines 72, 74, 76, compressor 80, compressed gas lines 78, 82, 84 and filter 50. Additionally, furnace heater 30 has been modified to accept and operate using gaseous hydrocarbon provided via gaseous hydrocarbon line 74. Further, delayed coker 40 is in fluid communication with compressed gaseous hydrocarbon line 78 and compressor 80 via compressed gaseous hydrocarbon line 82. Finally, in this system steam boiler 90 optionally provides steam to furnace heater 30 and coker feed line 34 via steam line 23. As described below, steam from boiler 90 is not utilized for stripping of volatile compounds from the coke product. Rather, boiler 90 optionally provides steam to delayed coker 40 only during the fill process.

With reference to FIG. 2, the present invention has been incorporated into a refinery that uses a delayed coker. Use of the present invention improves the production of desired hydrocarbon streams such as gasoline, diesel, jet fuel and kerosene. The system 7 of FIG. 2 is a non-limiting example of an improved system for increasing the production of the desired liquid hydrocarbon products.

In the depiction of FIG. 2, system 7 includes: atmospheric distillation unit 10, vacuum distillation unit 20, furnace heater 30, delayed coker 40 (typically two coke drums, individual coke drums are not shown and will be referred to herein as coke drum 40), filter 50, coker fractionator 60, acid gas cleanup unit 70, compressor 80, steam boiler 90, fluid catalytic cracking (FCC) plant 120 and hydrotreater 140. In the embodiment depicted in FIG. 2, FCC plant 120 and coker fractionator 60 provide hydrocarbon gases to acid gas cleanup unit 70 via lines 124 and 64 respectively. Operation of acid gas cleanup unit 70, coker fractionator 60, FCC plant 120, atmospheric distillation unit 10, vacuum distillation unit 20 and hydrotreater 140 will not be discussed in detail as the operation of such units are well known to those skilled in the art. For the purposes of the remaining disclosure, the product generated by acid gas cleanup unit 70 will be defined as a gaseous hydrocarbon product consisting primarily of C1 to C6 hydrocarbons. Methane comprises from about 50 to about 60 percent by weight of the gaseous hydrocarbon product with the longer chain hydrocarbons decreasing in concentration such that C5 and C6 comprise less than two percent by weight.

As will be described in more detail below in the discussion of the method for increasing the production of desired hydrocarbon liquids, the use of steam produced by steam boiler 90 is now optional in view of the modifications to system 7. Specifically, system 7 has been modified by incorporation of lines 72, 74, 76, compressor 80, compressed gas lines 78, 82, 84 and filter 50. Additionally, furnace heater 30 has been modified to accept compressed gas via compressed gas line 78. Further, delayed coker 40 is in fluid communication with compressed gas line 78 and compressor 80 via compressed gas line 82. Finally, in this system steam boiler optionally provides steam to furnace heater 30 and coker feed line 34 via steam line 23. As described below, steam from boiler 90 is not utilized for stripping of volatile compounds from the coke product. Rather, boiler 90 optionally provides steam to delayed coker 40 only during the fill process.

Methods

In one embodiment, the present invention provides methods for upgrading heavy crude oil from various sources to SCO. In general, the API values of the heavy crude processed according to this method will range between about zero and about 21. The discussion of this method will reference FIG. 1 as an example of one system suitable for practicing this method. According to this method, the heavy crude oil undergoes two initial processing steps prior to entering furnace 30. Initially, heavy crude oil flows through line 12 to an atmospheric distillation unit 10 and subsequently from atmospheric distillation unit 10 via line 16 to vacuum distillation unit 20.

Within atmospheric distillation unit 10, the heavy crude oil undergoes distillation to produce two products, a diluent usually a condensate and an atmospheric residual component usually known as atmospheric resid. The condensate is removed via line 14 while the atmospheric resid passes through line 16 to vacuum distillation unit 20. The atmospheric resid subsequently undergoes vacuum distillation with the resulting liquid hydrocarbon component, in this case commonly known as vacuum resid, exiting vacuum distillation unit 20 via line 24 and the vacuum gas oil component exiting vacuum distillation unit 20 via line 22.

Liquid hydrocarbon enters furnace 30 via line 24 and is heated to a temperature of about 450° C. to about 550° C., more preferably to a temperature between about 480° C. (895 F) to about 510° C. (950 F). Subsequently, the liquid hydrocarbon, and optionally steam, passes through line 34 into one of at least two coke drums forming delayed coker 40. Depending upon the feed material and operating conditions, surfaces within furnace 30 may be prone to fouling by carbon buildup. To preclude fouling of furnace 30, steam from boiler 90 may optionally be provided to line 24 via line 23. Thus, steam and liquid hydrocarbon enter furnace 30. Alternatively, during the coker drum 40 fill process, steam may be injected into furnace 30 via a line 23. In either case, the optional addition of steam to furnace 30 occurs only during the filling step of coker drum 40. Generally, coke drum 40 will operate at a gage pressure between 50 to 500 kPa or more preferably between 100 to 400 kPa (15 to 60 psig) and temperatures preferably between 480 C (895 F) and 500 C (930 F).

In the practice of the present method for upgrading heavy crude oil to SCO, steam injection to furnace 30, if used, ceases when the flow of liquid hydrocarbon from furnace 30 to coker drum 40 stops. Accordingly, steam injection into furnace 30 during the filling of a coker drum does not play a role stripping of volatiles from the resulting coke product. However, as described in more detail below, steam injection during coker drum filling may be replaced with gaseous hydrocarbons.

In general, when practicing the method of upgrading heavy crude oil to SCO the coking process operates coker drum 40 during the fill process at a gage pressure between about 50 to 500 kPa. More typically, the coker drum will be maintained during the fill process at a gage pressure between 100 to 400 kPa (15 to 60 psig). Within coker drum 40, the liquid hydrocarbon undergoes the thermal cracking process and reaction steps discussed above. Thus, the coking process cracks the large hydrocarbons into smaller volatile compounds and solid coke.

As the hot feedstock enters coke drum 40, larger molecules crack into smaller volatile compounds and solid coke. As the coking reaction progresses, volatile material exits coker drum 40 through line 44 while solid coke accumulates from bottom to top within coker drum 40. Under typical operating conditions, filling of coker drum 40 with coke requires between about 8 to about 12 hours. In the method of the present invention, volatile compounds trapped within the solid coke and adhering to the surface of the coke and coker drum are removed by stripping with gaseous hydrocarbons obtained from refinery operations including gaseous hydrocarbons obtained from coking fractionator 60. Following the gaseous hydrocarbon stripping step, conventional water quench and decoking steps are carried out.

In the method of upgrading heavy crude oil to SCO, the gaseous hydrocarbon stripping process replaces the conventional steam stripping currently practiced in coking operations. Additionally, the present invention optionally permits replacement of all steam used during coking operations except for the steam/high pressure water used during decoking operations.

Accordingly, in the method of upgrading heavy crude oil to SCO, a gaseous hydrocarbon stream obtained from compressor 80 passes to furnace heater 30 via line 78. The compressed gaseous hydrocarbon stream is separated into two streams 82 and 84 inside furnace heater 30. Thus, the configuration of system 5 permits the optional use of steam from steam boiler 90 during the fill process; however, the method also provides for the replacement of the steam normally used in the stripping process with compressed gaseous hydrocarbons. In this version of the improved method, compressed gaseous hydrocarbons from compressor 80 pass through line 78 to line 82 or line 84. During the stripping process the heated gaseous hydrocarbons from line 82 enter coke drum 40 through a port (not shown) in the bottom of coke drum 40. Typically, the gaseous hydrocarbons used during the hydrocarbon-stripping step are heated to a temperature between about 450° C. and about 550° C. More preferably, the gaseous hydrocarbons are heated to a temperature between about 490° (915 F) and about 510° C. (950 F).

Thus, in the disclosed method, the steam-stripping step for removing unreacted volatile compounds from coke drum 40 is replaced by a hydrocarbon-stripping step using the gaseous hydrocarbon product from acid gas cleanup unit or other suitable processing unit capable of producing the desired gaseous hydrocarbons. The quantity of gaseous hydrocarbon by weight injected into coke drum 40 may range from about 1% to about 5% by weight of the original feed to coke drum 40. More typically, the quantity of gaseous hydrocarbon used will be between about 1% to about 2% by weight of the original feed to coke drum 40.

In the method of upgrading heavy crude oil to SCO, liquids produced from coke drum 40 pass via line 44 to an optional filter 50. Filter 50 traps any entrained coker fine particles that may have exited through the vapor line 44. Filter 50 generally comprises a material having pores of 1 to 40 micron size or more preferable between 1 to 20 micron size suitable for trapping the majority of solid particles of greater than one micron. Filter 50 may be of ceramic or metallic composition or any other material suitable for operating under the conditions experienced. Typically, filter 50 may experience temperatures between 450° C. and 520° C. More typically, filter 50 will operate under conditions of about 480° C. (895 F) to about 510° C. (950 F), thereby assuring that substantially all hydrocarbons passing through line 54 remain in the vapor phase prior to entering the fractionator 60.

As depicted in FIG. 1, fractionator 60 yields product in the form of coker oil and coker gas. Coker gas passes through line 64 to acid cleanup unit 70. Gaseous hydrocarbons from acid clean up unit 70 then pass either through line 74 to furnace 30 for use as fuel or through line 76 to compressor 80 for use within the above described method. Optionally, the gaseous hydrocarbons may also replace all steam used during the fill cycle of coke drum 40.

Thus the present method advantageously uses the coker gaseous stream consisting primarily of inorganic and organic gases that are usually cleaned and flared as waste stream or burned to generate heat in a refinery. To provide control over the flow of gaseous hydrocarbons from acid gas clean up unit 70 to coker 40, the initial stream from acid gas clean up unit is divided into two streams 74 and 76 before compressor 80. Splitting of the gaseous hydrocarbon stream provides control over the flow rate of the stream through line 76, such that only the amount required by coker 40 passes through line 82 or 84. A common control valve, not shown, provides the operator with the ability to manage gas flow. Typically, gaseous hydrocarbon flow through either line 82 or 84 will be maintained within 0.5 wt % to 20 wt % of the flow passing through feed line 24 into heater 30. Under most common operating conditions, gaseous hydrocarbon flow through either line 82 or 84 will be maintained within 7 wt % to about 15 wt %. In general, a target hydrocarbon flow of about 10 wt % through either line 82 or 84 will be maintained. If desired, the hydrocarbon stream in line 74 may be used as fuel to heat the furnace 30.

With continued reference to FIG. 1, coker liquid produced by fractionator 60 passes via line 62 to a hydrotreater (not shown) for stabilization before entering blending unit 100 or passing into storage tanks or a pipe line for subsequent transportation to a refinery for processing. If gas oil or other similar lighter crude produce is available, coker liquid will normally pass to blending unit 100 for blending with gas oil. For example, as depicted in FIG. 1 gas oil from vacuum distillation unit 20 passes via line 22 to blending unit 100 for blending with coker oil to yield SCO suitable for subsequent processing in refinery or shipping via a pipeline. The SCO is removed from blending unit 100 via line 110.

The quantity of coke produced according to this method may vary between 20 to 30 wt % of the feedstock provided to furnace heater 30.

The resulting synthetic crude liquid has the following properties: an API ranging from about 21 to about 30; a boiling point range between about 50° C. and about 530° C. (about 120° F. to about 1,100° F.). The method and system of the present invention is capable of a SCO production rate of about 750 bbl to about 850 bbl per thousand barrels of resid feedstock.

System 5 as depicted in FIG. 1 is also capable of completely replacing steam during the practice of the foregoing method. To eliminate steam during the fill step of the coking process, the method adds heated gaseous hydrocarbons from compressor 80 via line 84 to coker feed line 34. The gaseous hydrocarbon stream enters coker feed line 34 at a temperature between about 450° C. and about 550° C. and at a velocity consistent with that of the previously used steam velocity. The velocity of the heated gaseous hydrocarbons will depend on the operating conditions of temperature and pressure. Typically, when used during the fill process, the gaseous hydrocarbons in line 84 equal about 0.5 to 2 wt % of the feed stream to coke drum 40. When using the gaseous hydrocarbon stream in place of steam during the fill cycle, the gaseous hydrocarbon stream does not flow through line 82 to coke drum 40 until necessary for the hydrocarbon-stripping step.

FIG. 2 provides one example of a system suitable for practicing the method disclosed herein in the environment of a refinery. When practicing the method in the environment of a refinery using a delayed coker plant, the method initially processes a crude oil in an atmospheric distillation unit 10. Distillation unit 10 yields naphtha, a middle distillate and atmospheric resid. The resulting naphtha stream and middle distillate pass through lines 14 and 18 respectively to hydrotreater 140. The atmospheric resid passes via line 16 to vacuum distillation unit 20. Vacuum distillation unit produces a vacuum gas oil and a liquid hydrocarbon component commonly known as vacuum resid. Vacuum gas oil passes via line 22 to FCC plant 120 while the liquid hydrocarbon passes via line 24 to furnace heater 30. In system 7, acid gas cleanup unit 70 receives feed from both coker fractionator 60 and FCC plant 120 via lines 64 and 124 respectively.

Furnace 30 heats the liquid hydrocarbon to between about 450° C. to about 550° C. More typically, furnace 30 heats the liquid hydrocarbon to between about 480° C. (895 F) to about 510° C. (950 F). Subsequently, the liquid hydrocarbon, and optionally steam, passes through line 34 into one of at least two coke drums forming delayed coker 40. Depending upon the feed material and operating conditions, surfaces within furnace 30 may be prone to fouling by carbon buildup. To preclude fouling of furnace 30, steam from boiler 90 may optionally be provided to line 24 via line 23. Thus, steam and liquid hydrocarbon enter furnace 30. Alternatively, during the coker drum 40 fill process, steam may be injected into furnace 30 via a line 23. In either case, the optional addition of steam to furnace 30 occurs only during the filling step of coker drum 40. Further, as described in more detail below, steam injection during coker drum filling may be replaced with gaseous hydrocarbons.

In general, when practicing the method of the present invention in the environment of a refinery the coking process maintains coker drum 40 at a gage pressure between about 50 to 500 kPa. More typically, coker drum 40 will be maintained at a gage pressure between 100 to 400 kPa (15 to 60 psig). Further, coker drum will typically operate at a temperature between about 480° C. and about 500° C. (895 F to about 930 F) during the fill/conversion and stripping processes. Within coker drum 40, the liquid hydrocarbon undergoes the thermal cracking process and reaction steps discussed above. Thus, the coking process cracks the large hydrocarbons into smaller volatile compounds and solid coke.

As the hot feedstock enters coke drum 40, larger molecules crack into smaller volatile compounds and solid coke. As the coking reaction progresses, volatile material exits coker drum 40 through line 44 while solid coke accumulates from bottom to top within coker drum 40. Under typical operating conditions, filling of coker drum 40 with coke requires between about 8 to about 12 hours. In the method of the present invention, volatile compounds trapped within the solid coke and adhering to the surface of the coke and coker drum are removed by stripping with gaseous hydrocarbons obtained and from refinery operations including gaseous hydrocarbons obtained from coking fractionator 60. Following the gaseous hydrocarbon stripping step, conventional water quench and decoking steps are carried out.

Thus, the gaseous hydrocarbon stripping process replaces the conventional steam stripping currently practiced in coking operations. Additionally, the present invention optionally permits replacement of all steam used during coking operations except for the steam/high pressure water used during decoking operations.

Accordingly, in the environment of a refinery using a coker 40 to increase valuable liquid products, a gaseous hydrocarbon stream obtained from compressor 80 passes to furnace heater 30 via line 78. The compressed gaseous hydrocarbon stream is separated into two streams 82 and 84 inside furnace heater 30, thereby allowing simultaneous addition of gaseous hydrocarbons through line 82 and 84. Thus, the configuration of system 7 permits the optional use of steam from steam boiler 90 when required during the fill process; however, the method also provides for the replacement of the steam normally used during the filling process with compressed gaseous hydrocarbons. Typically, the gaseous hydrocarbons used during the hydrocarbon-stripping step are heated to a temperature between about 450° C. and about 550° C. More preferably, the gaseous hydrocarbons are heated to a temperature between about 490° (915 F) and about 510° C. (950 F).

When practicing the improved coking method in the environment of a refinery to increase liquid yield, use of the additional gaseous hydrocarbons passing through line 82 during the fill and stripping steps improves the coker liquid yield. The quantity of gaseous stream that is injected through line 82 at the bottom of the coke drum 40 may range from 2% to 20%, more preferably between 5% to 10% by weight of the original feed passing from vacuum distillation unit 20 to coker drum 40. Thus, the present method provides for replacement of the steam-stripping step with a gaseous hydrocarbon-stripping step and optionally for replacement of all steam used during the coking process.

In the method of production of additional liquid in a refinery using delayed coker 40, the liquids produced from coke drum 40 passes via line 44 to an optional filter 50. Filter 50 traps any entrained coker fine particles that may have exited through the vapor line 44. Filter is a material having pores of 1 to 40 micron size or more preferable between 1 to 20 micron size suitable for trapping any solid particles of greater than one micron. Filter 50 may be of ceramic or metallic composition or any other material suitable for operating under the conditions experienced. Typically, filter 50 may experience temperatures between 430° C. and 520° C. More typically, filter 50 will operate under conditions of about 480° C. to about 510° C. thereby assuring that substantially all hydrocarbons passing through line 54 remain in the vapor phase prior to entering the fractionator 60.

As depicted in FIG. 2, fractionator 60 yields product in the form of coker oil and coker gas. Coker gas passes through line 64 to acid cleanup unit 70. Gaseous hydrocarbons from acid clean up unit 70 then pass either through line 74 to furnace 30 for use as fuel or through line 76 to compressor 80 for use within the above described method. Coker gas oil passes to FCC plant 120. Thus the present method advantageously uses the coker gaseous stream consisting primarily of inorganic and organic gases that are usually cleaned and flared as waste stream or burned to generate heat in a refinery. Although described herein as using an acid gas cleanup unit as the source of gaseous hydrocarbons, any refinery processing unit capable of producing the desired hydrocarbons may be utilized.

To provide control over the flow of gaseous hydrocarbons from acid gas clean up unit 70 to coker 40, the initial stream from acid gas clean up unit is divided into two streams 74 and 76 before compressor 80. Splitting of the gaseous hydrocarbon stream provides control over the flow rate of the stream through line 76 such that only the amount required by coker 40 passes through line 82 or 84. Typically, gaseous hydrocarbon flow through either line 82 and/or 84 will be maintained within 0.5 wt % to 20 wt % of the feed line 24 entering the heater 30. If desired, the hydrocarbon stream in line 74 is used as fuel to heat the furnace 30.

As depicted in FIG. 2, system 7 operates within a refinery. In this embodiment, the filtered volatile compounds from coke drum 40 pass into fractionator 60 and are separated into heavy coker gas oil, coker distillate and coker gas. Coker gas oil passes via line 66 to FCC plant 120 for blending and processing with the FCC feedstock. The coker distillate passes via line 62 to hydrotreater 140 for blending and processing with the FCC cracked distillate, the straight run distillate produced by atmospheric distillation unit 10 and naphtha produced by atmospheric distillation unit 10 to produce a clean transportation fuel.

System 7 as depicted in FIG. 2 is also capable of completely replacing steam during the practice of the foregoing method. To eliminate steam during the fill step of the coking process, the method adds gaseous hydrocarbons from compressor 80 via line 84 to coker feed line 34 and also at the bottom of coker 40 via line 82 at a velocity consistent with that of the previously used steam. Typically, when used during the fill process, the gaseous hydrocarbons in line 84 equal about 0.5 to 2 wt % of the feed stream to coke drum 40. Subsequently during the stripping process, the quantity of gaseous hydrocarbon stream that is injected through line 82 at the bottom of the coke drum 40 is reduced to about 0.5% to about 2.0% by weight of the original feed passing from vacuum distillation unit 20 to coke drum 40 and gaseous stream may flow through line 84 if required.

When compared to conventional steam heating practices, the practice of the current method in connection with a delayed coker 40 in the environment of a refinery produces additional liquid yields of better quality with increase in hydrogen to carbon ratios. Total liquid yield accounts for about 75 to 85 volume percentage of the feedstock volume. The amount of net additional liquid yield as compared the practice of conventional operation, ranges between 5% to 10% by volume of the total liquid yield. The percentage increase will depend upon the quality of the feedstock, quantity of the gaseous stream used in place of steam to provide heat during the fill cycle, pressure in the coke drum 40 and the temperature of the coker furnace 30. Further, the quantity of coke produced according to this method is reduced when compared to conventional method by about 2% to 5% by weight of the original coke produced, thus reducing the coking cycle time, and hence improve the economics of the process.

The following non-limiting examples demonstrate the capabilities of the above described methods. The data provided herein was generated using a three inch diameter continuous delayed coker pilot plant having a volume of 509 cubic inches. Examples were prepared using a vacuum resid feedstock derived from oil sands bitumen, obtained from Alberta, Canada. The vacuum resid feedstock used in examples had the following properties:

| Properties | |
|---|---|
| API Gravity | 2.5 |
| Asphaltenes, wt % | 25 |
| Conradson Carbon Residue, wt % | 20 |
| Sulfur, wt % | 5.6 |
| Nitrogen, ppm | 3200 |
| Nickel, ppm | 150 |
| Vanadium, ppm | 303 |

In each example, resid feedstock was stored in a feed tank maintained at 150° C. and delivered to a furnace heater at a rate of 3,600 gram/hour. The furnace outlet temperature was maintained at 930° F. (500° C.). During the coking process, the coker drum pressure operated at either 15 psig or 40 psig. On average, the fill times for the pilot plant coker required between 3 to 4 hours.

Since the examples were carried out in a delayed coker pilot plant in a laboratory, the source of gaseous hydrocarbons was simulated using pure methane or a mixture of $C_1$ (82 mole %), $C_2$ (10 mole %) and $C_3$ (mole 8%) hydrocarbons stored in a pressurized cylinder. As in a hydrocarbon processing facility the hydrocarbon gaseous stream may contain more than 60% by volume of methane thus replacing it with the indicated gases in a laboratory situation adequately duplicates the hydrocarbon processing facility environment. When used to replace conventional steam during the coking process, methane or mixture of hydrocarbons was pre-heated to a temperature greater than 350° C. in a fluidized sand bath before injecting into the furnace. Additionally, to demonstrate the ability to increase liquid yields with the injection of additional gaseous hydrocarbons (as shown in line 82 in FIGS. 1 and 2), hydrocarbon mixture from a cylinder was injected at the bottom of the coker drum through a side jet during the filling of the coker drum.

The fractionator (60 in FIGS. 1 & 2) in a commercial plant was simulated by using hot and cold separators per normal pilot plant operations. However, the light and heavy liquid fractions from the two separators were combined to determine the total liquid effluent yield and detailed properties were further analyzed. On-line gas chromatography was used for gas analysis to determine quality and quantity. Coke yield was determined by weighing the coke drum with the coke. Mass balances were closed in all cases.

In another example designed to demonstrate the ability to increase liquid yield using additional gaseous hydrocarbon (5 wt % to 20 wt % of the feed) during the fill cycle, the fill step was carried out using methane or mixture of hydrocarbons and the stripping step was carried out with the same hydrocarbon. To provide a comparison, immediately after the coking portion was over, select runs used water, added to the furnace at a rate of 40 ml/hr to generate steam. Steam-stripping was carried out for 60 min to recover the additional liquid from the coke bed. Regardless of whether steam or methane was used to strip the coker, following stripping the coke drum was quenched with water.

Example 1

This example demonstrates that steam could be replaced by gaseous hydrocarbons, both during the step of filling the coke drum and during the stripping step at the end of the run in a commercial delayed coking process. Tables 1 and 2 provide the experimental data for two different feedstocks having API 2.5 and 7.6 respectively. Steam and hydrocarbon velocities are shown in the description of the run conditions.

TABLE 1

Comparison of product yields when steam is replaced by methane (heavy feedstock of API 2.5)

| Pilot plant run conditions | Control run-1 | Column 2 | Column 3 | Control run-2 | Column 4 | Column 5 |
|---|---|---|---|---|---|---|
| Temp, ° C. (° F.) | 499 (930) | 499 (930) | 499 (930) | 499 (930) | 499 (930) | 499 (930) |
| Pressure, kPa | 276 (40) | 276 (40) | 276 (40) | 103 (15) | 103 (15) | 103 (15) |

TABLE 1-continued

| Comparison of product yields when steam is replaced by methane (heavy feedstock of API 2.5) | | | | | | |
|---|---|---|---|---|---|---|
| Pilot plant run conditions | Control run-1 | Column 2 | Column 3 | Control run-2 | Column 4 | Column 5 |
| (psig) | | | | | | |
| Material used during filling coke drum | Steam @ 1.36 Acf/h | Methane @ 1.37 Acf/h | Methane @ 1.37 Acf/h | Steam @ 2.52 Acf/h | Methane @ 2.53 Acf/h | Methane @ 7.76 Acf/h |
| Material used during stripping | Steam @ 1.36 Acf/h | Steam @ 1.36 Acf/h | Methane @ 1.37 Acf/h | Steam @ 2.52 Acf/h | Methane @ 2.53 Acf/h | Methane @ 7.76 Acf/h |
| Product yields, wt % feed | | | | | | |
| Liquid | 63.3 | 63.7 | 64.5 | 68.4 | 69.3 | 68.6 |
| Coke | 27.4 | 26.0 | 26.0 | 22.0 | 22.2 | 22.9 |
| Gas | 9.3 | 10.3 | 9.5 | 9.6 | 8.5 | 8.5 |

ACFH is Actual Cubic Feet Per Hour

TABLE 2

| Comparison of product yields when steam is replaced by methane (Lighter feedstock of API 7.6) | | | | |
|---|---|---|---|---|
| Pilot plant run conditions | Control run-3 | Column 6 | Control run-4 | Column 7 |
| Temp, ° C. (° F.) | 499 (930) | 499 (930) | 499 (930) | 499 (930) |
| Pressure, kPa (psig) | 276 (40) | 276 (40) | 103 (15) | 103 (15) |
| Material used during filling coke drum | Steam @ 1.36 Acf/h | Methane @ 1.37 Acf/h | Steam @ 2.52 Acf/h | Methane @ 2.53 Acf/h |
| Material used during stripping | Steam @ 1.36 Acf/h | Methane @ 1.37 Acf/h | Steam @ 2.52 Acf/h | Methane @ 2.53 Acf/h |
| Product yields, wt % feed | | | | |
| Liquid | 68.4 | 68.8 | 72.2 | 72.1 |
| Coke | 233 | 23.6 | 20.6 | 20.3 |
| Gas | 8.3 | 7.7 | 7.2 | 7.6 |

In these examples, a control run was carried out using steam during the step of filling the coke drum and during the stripping step. Velocities of steam and methane were kept at the same rate of cubic feet per hour at run conditions while the coker was operated at pressures of 15 psig and 40 psig. In Column 2 methane was introduced only during the filling step but was discontinued and steam used for the stripping step. In Columns 3 and 4, methane replaces steam during both the filling and stripping steps. In Column 5, methane velocity was tripled to see if methane velocity has any effect on the process yields. Results in Table 2 were generated using the same operating conditions but replacing the API 2.5 feed with a lighter feedstock of API 7.6.

The results in Tables 1 and 2 suggest that the yields of gas, liquid and coke vary within a percentage point (within the experimental errors of the pilot plant) in all conditions when steam (in control run) is replaced by methane.

With reference to Table 3, replacement of steam with a mixture of hydrocarbon gases containing methane (82 mole %), ethane (10 mole %) and propane (8 mole %) to simulate a typical refinery off-gas hydrocarbon gaseous stream, produced results are almost of the same order as that of the control runs carried over with steam and other runs using pure methane. The results clearly demonstrates that in a commercial delayed coker operation, steam use during the filling and stripping steps can be replaced with hydrocarbon mixture such as refinery off-gas or natural gas, whose quality and quantity can be varied depending on the economics of the availability of the hydrocarbon mixture.

TABLE 3

| Comparison of product yields when steam is replaced by a mixture of gaseous hydrocarbons containing C1(82 mole %) + C2 (10 mole %) + C3 (mole 8%) (Lighter feedstock of API 7.6) | | | | |
|---|---|---|---|---|
| Pilot plant run conditions | Control run-5 | Column 5A | Control-6 | Column 6B |
| Temp, ° C. (° F.) | 499 (930) | 499 (930) | 499 (930) | 499 (930) |
| Pressure, kPa (psig) | 276 (40) | 276 (40) | 103 (15) | 103 (15) |
| Material used during filling coke drum | Steam @ 1.36 Acf/h | Hydro-carbons @ 1.37 Acf/h | Steam @ 2.52 Acf/h | Hydro-carbons @ 2.53 Acf/h |
| Material used during stripping | Steam @ 1.36 Acf/h | Hydro-carbons @ 1.36 Acf/h | Steam @ 2.52 Acf/h | Hydro-carbons @ 2.52 Acf/h |
| Product yields, wt % feed | | | | |
| Liquid | 68.4 | 67.2 | 72.2 | 70.8 |
| Coke | 23.3 | 23.8 | 20.6 | 21.5 |
| Gas | 8.3 | 9.0 | 7.2 | 7.9 |

Thus, as demonstrated by Table 3, the improved process will reduce the amount of waste water generated during coking operations. Replacement of high cost steam with readily available low cost hydrocarbon stream reduces operating costs without reducing coke yield.

Although there was no significant change in liquid yields when steam was replaced by methane, further analysis of the quality of the liquid indicates that methane actually stripped more of the heavier hydrocarbons such as distillate and gas oil (about 2 wt % more at 15 psig and 5 wt % more at 40 psig) and less of the lighter naphtha as compared to the steam.

Example 2

This example demonstrates the resulting increase in liquid yields when replacing steam during the fill process with increased concentrations of methane at various conditions. Table 4 shows the results for the heavier coker feedstock of API 2.5 and Table 5 shows the results for the lighter coker feedstock of API 7.6.

As demonstrated by Table 4, operating the pilot coker with an increased amount of methane during the fill process increases the liquid yield. When operating at 40 psig, the liquid yield increased by about 5 wt % with the addition of methane at a flow rate of 13.1 cf/h (column 8), while the liquid yield increased further by 2 wt % to 70.4 wt % of the feed when methane flow rate almost doubled to 26.6 cf/h (column 9). The increase in liquid yield corresponded to a decrease in coke yield from 27.4 wt % to 24.1% to 21.1 wt % with the increase in methane concentrations.

TABLE 4

Comparison of product yields with increasing amount of methane added during filling of coke drum (feedstock of API 2.5)

| Pilot plant run conditions | Control run-1 | Column 8 | Column 9 | Control run-2 | Column 10 | Column 11 |
|---|---|---|---|---|---|---|
| Temp, ° C. (° F.) | 499 (930) | 499 (930) | 499 (930) | 499 (930) | 499 (930) | 499 (930) |
| Pressure, kPa (psig) | 276 (40) | 276 (40) | 276 (40) | 103 (15) | 103 (15) | 103 (15) |
| Material used during filling coke drum | Steam @ 1.36 Acf/h | Methane @ 13.1 Acf/h | Methane @ 26.6 Acf/h | Steam @ 2.52 Acf/h | Methane @ 25.2 Acf/h | Methane @ 48.9 Acf/h |
| Material used during stripping | Steam @ 1.36 Acf/h | Steam @ 1.36 Acf/h | Steam @ 1.36 Acf/h | Steam @ 2.52 Acf/h | Steam @ 2.52 Acf/h | Steam @ 2.52 Acf/h |
| Product yields, wt % feed | | | | | | |
| Liquid | 63.3 | 68.1 | 70.4 | 68.4 | 73.6 | 72.8 |
| Coke | 27.4 | 24.1 | 21.1 | 22.0 | 19.2 | 19.9 |
| Gas | 9.3 | 7.8 | 8.5 | 9.6 | 7.2 | 7.3 |

The results in Table 4 further demonstrates that, while operating at a lower pressure of 15 psig, liquid yield increased by about 5 wt % with the addition of methane at 25.2 of/h. However, further increasing methane volume to 48.9 cf/h (column 11) did not produce any significant change in the yields of liquid, coke or gas. These results are consistent with the fact that at lower pressures addition of methyl or hydrogen radicals is ineffective as compared to higher pressures. Further, these results demonstrate that addition of excess gaseous hydrocarbon in a commercial environment operating at lower pressures will not produce an economic benefit.

Table 5 demonstrates that the method of increasing the liquid yield is not limited to one feedstock.

TABLE 5

Comparison of product yields with increasing amount of methane added during filling of coke drum at higher pressure of 40 psig (feedstock of API 7.6)

| Pilot plant run conditions | Column 12 | Column 13 | Column 14 | Column 15 |
|---|---|---|---|---|
| Temp, ° C. (° F.) | 499 (930) | 499 (930) | 499 (930) | 499 (930) |
| Pressure, kPa (psig) | 276 (40) | 276 (40) | 276 (40) | 276 (40) |
| Material used during filling coke drum | Methane @ 1.37 Acf/h | Methane @ 6.8 Acf/h | Methane @ 13.1 Acf/h | Methane @ 26.6 Acf/h |
| Material used during stripping | Steam @ 1.36 Acf/h | Steam @ 1.36 Acf/h | Steam @ 1.36 Acf/h | Steam @ 1.36 Acf/h |
| Product yields, wt % feed | | | | |
| Liquid | 68.8 | 70.9 | 73.4 | 75.0 |
| Coke | 23.6 | 21.3 | 19.6 | 18.6 |
| Gas | 7.7 | 7.8 | 7.0 | 6.4 |

The example in Table 5 illustrates that when using a feedstock suitable for producing anode grade coke (of higher API or lower density), the results are quite encouraging. The feedstock used in Table 5 had an API gravity of 7.6 with an asphaltenes content of 8.0 wt % and a carbon residue of 19.3 wt %. As reflected in Table 5, when operating at a pressure of 40 psig the current method produced an increase in liquid production as the volume of methane increased during the fill process. As demonstrated, increasing the volume of methane with the increase in velocity from 1.37 cf/h to 26.6 cf/h increased the liquid yield from 68.8 wt % to 75.0 wt % of the feed. Increase in liquid yield is followed by corresponding decrease in coke yield in all cases.

For the example represented by Table 5, elemental analysis of the liquid products further continued the fact that H/C atomic ratios of the liquid product increased from 1.7 to 1.9 with the addition of methane at both pressures and flow rates.

The improved systems and methods described provide several advantages economically and environmentally. Replacing steam with gaseous hydrocarbons during the coker drum filling step or during the stripping step will enhance the liquid production, decrease the solid coke production and decrease the demand of steam. Hence the cost of steam generation and waste water production will be decreased. Though most of the experiments used in the examples rely on methane and mixtures of gaseous hydrocarbons containing from one to three carbon atoms and specific feed stocks, those skilled in the art will understand that that refinery off gases containing gaseous hydrocarbons will perform satisfactorily in the methods disclosed herein in conjunction with a wide range of API feed stocks.

Other embodiments of the improved systems and methods will be apparent to those skilled in the art. As such, the foregoing disclosure merely enables and describes the general uses, methods and descriptions of the improved systems and methods. Accordingly, the following claims define the true scope of the improvements disclosed herein.

We claim:

1. A delayed coking method comprising:

passing liquid hydrocarbons through a furnace heater;

passing the heated liquid hydrocarbons out of said furnace heater to a coke drum;

passing gaseous hydrocarbons to a compressor;

compressing said gaseous hydrocarbons and passing said compressed hydrocarbons to said furnace heater;

within the furnace heater, splitting the compressed hydrocarbon into a first stream of compressed hydrocarbons and a second stream of compressed hydrocarbons;

blending the first stream of compressed hydrocarbons with the heated liquid hydrocarbons to form a combined stream of heated liquid hydrocarbons and the first stream of compressed hydrocarbons;

filling the coke drum with the combined stream of heated liquid hydrocarbons and the first stream of compressed hydrocarbons, wherein during the filling of the coke drum the heated liquid hydrocarbons undergo a conversion to coke and volatile hydrocarbons;

optionally passing steam into said coke drum while filling said coke drum with said heated liquid hydrocarbons;

stopping flow of said combined stream of heated liquid hydrocarbons and the first stream of compressed hydrocarbons to said coke drum and stopping the flow of any steam to said coke drum;

after stopping flow of said combined stream of heated liquid hydrocarbons and the first stream of compressed hydrocarbons and flow of any steam to said coke drum, stripping said volatile hydrocarbons from said coke by passing said second stream of compressed hydrocarbons which have been heated to a temperature between about 450° C. to about 550° C. within said furnace heater from said furnace heater into said coke drum, wherein upon entering said coke drum, said second stream of compressed hydrocarbons pass through said coke and strip volatile hydrocarbons entrained within the coke, said second stream of compressed hydrocarbons and volatile hydrocarbon exit said coke drum through a port located at or near the top of said coke drum.

2. The method of claim 1, wherein said heated liquid hydrocarbons are heated to a temperature between about 450° C. and about 550° C. while passing through said furnace heater.

3. The method of claim 1, wherein said coke drum is maintained at a temperature between about 480° C. and 500° C. and a pressure between about 50 to 500 kPa for a period of time sufficient to produce petroleum coke.

4. The method of claim 1, wherein said compressed hydrocarbons are heated to a temperature of between about 490° C. and about 510° C. while passing through said furnace heater.

5. The method of claim 1, wherein during the step of stripping said volatile hydrocarbons from said coke, the quantity of said compressed hydrocarbons is from about 1% to about 20% by weight of the quantity of heated liquid hydrocarbons entering said coke drum during said filling step.

6. The method of claim 1, wherein during the filling step, the quantity of said compressed hydrocarbons entering said coke drum is from about 0.5% to about 20% by weight of the quantity of heated liquid hydrocarbons.

7. The method of claim 1, wherein said first stream of compressed hydrocarbons is from about 1% to about 5% by weight of said heated liquid hydrocarbons.

8. The method of claim 1, further comprising the step:

passing said second stream of compressed hydrocarbons into said coke drum directly at a bottom of the coke drum.

9. The method of claim 8, wherein said second stream of compressed hydrocarbons is from about 0.5% to about 20% by weight of the heated liquid hydrocarbons.

10. A delayed coking method comprising:

passing liquid hydrocarbons through a furnace heater;

passing the heated liquid hydrocarbons out of said furnace heater to a coke drum;

passing gaseous hydrocarbons to a compressor;

compressing said gaseous hydrocarbons and passing said compressed hydrocarbons to said furnace heater;

within said furnace heater, splitting said compressed hydrocarbons into a first stream of compressed hydrocarbons and a second stream of compressed hydrocarbons;

filling the coke drum with the heated liquid hydrocarbons, wherein during the filling of the coke drum with the heated liquid hydrocarbons, the heated liquid hydrocarbons undergo a conversion to coke and volatile hydrocarbons;

optionally passing steam into said coke drum while filling said coke drum with said heated liquid hydrocarbons;

stopping flow of said heated liquid hydrocarbons to said coke drum and stopping the flow of any steam to said coke drum;

after stopping flow of heated liquid hydrocarbons and flow of any steam to said coke drum, stripping said volatile hydrocarbons from said coke by passing said second stream of compressed hydrocarbons which have been heated to a temperature between about 450° C. to about 550° C. within said furnace heater from said furnace heater into a bottom of said coke drum, wherein upon entering said coke drum, said second stream of compressed hydrocarbons pass through said coke and strip volatile hydrocarbons entrained within the coke, said second stream of compressed hydrocarbons and volatile hydrocarbon exit said coke drum through a port located at or near the top of said coke drum.

11. The method of claim 10, wherein said second stream of compressed hydrocarbons is from about 0.5% to about 20% by weight of the heated liquid hydrocarbons.

12. The method of claim 10, further comprising the step of:

blending the first stream of compressed hydrocarbons with the liquid hydrocarbons to form a combined stream of said heated liquid hydrocarbons and said first stream of compressed hydrocarbons prior to passing the combined stream of heated liquid hydrocarbons and said first stream of compressed hydrocarbons into the coke drum.

13. The method of claim 12, wherein said first stream of compressed hydrocarbons is from about 1% to about 5% by weight of said heated liquid hydrocarbons.

14. The method of claim 10, wherein said heated liquid hydrocarbons are heated to a temperature between about 450° C. and about 550° C. while passing through said furnace heater.

15. The method of claim 10, wherein said coke drum is maintained at a temperature between about 480° C. and 500° C. and a pressure between about 50 to 500 kPa for a period of time sufficient to produce petroleum coke.

16. The method of claim 10, wherein said compressed hydrocarbons are heated to a temperature of between about 490° C. and about 510° C. while passing through said furnace heater.

17. A delayed coking method comprising:

passing liquid hydrocarbons through a furnace heater;

passing the heated liquid hydrocarbons out of said furnace heater to a coke drum;

passing gaseous hydrocarbons to a compressor;

compressing said gaseous hydrocarbons and passing said compressed hydrocarbons to said furnace heater;

within said furnace heater, splitting said compressed hydrocarbons into a first stream of compressed hydrocarbons and a second stream of compressed hydrocarbons;

combining said first stream of compressed hydrocarbons with said heated liquid hydrocarbons thereby forming a combined stream of heated liquid hydrocarbons and compressed hydrocarbons;

filling the coke drum with the combined stream of heated liquid hydrocarbons and compressed hydrocarbons, wherein during the filling of the coke drum with combined stream of heated liquid hydrocarbons and compressed hydrocarbons, the heated liquid hydrocarbons undergo a conversion to coke and volatile hydrocarbons;

optionally passing steam into said coke drum while filling said coke drum with said heated liquid hydrocarbons;

stopping flow of the combined stream of heated liquid hydrocarbons and compressed hydrocarbons to said coke drum and stopping the flow of any steam to said coke drum;

after stopping flow of the combined stream of heated liquid hydrocarbons and compressed hydrocarbons and flow of any steam to said coke drum, stripping said volatile hydrocarbons from said coke by passing said second stream of compressed hydrocarbons which have been heated to a temperature between about 450° C. to about 550° C. within said furnace heater from said furnace heater into a bottom of said coke drum, wherein upon entering said coke drum, said second stream of compressed hydrocarbons passes through said coke and strips volatile hydrocarbons entrained within the coke, said second stream of compressed hydrocarbons and volatile hydrocarbon exit said coke drum through a port located at or near the top of said coke drum.

18. The method of claim 17, wherein said second stream of compressed hydrocarbons is from about 0.5% to about 20% by weight of the heated liquid hydrocarbons.

19. The method of claim 17, wherein said first stream of compressed hydrocarbons is from about 1% to about 5% by weight of said heated liquid hydrocarbons.

20. The method of claim 17, wherein said heated liquid hydrocarbons are heated to a temperature between about 450° C. and about 550° C. while passing through said furnace heater.

21. The method of claim 17, wherein said coke drum is maintained at a temperature between about 480° C. and 500° C. and a pressure between about 50 to 500 kPa for a period of time sufficient to produce petroleum coke.

22. The method of claim 17, wherein said compressed hydrocarbons are heated to a temperature of between about 450° C. and about 550° C. while passing through said furnace heater.

23. The method of claim 17, wherein said compressed gaseous hydrocarbons are obtained from a refinery processing unit.

* * * * *